US005324020A

United States Patent [19]

Rasmussen et al.

[11] Patent Number: 5,324,020

[45] Date of Patent: Jun. 28, 1994

[54] PAPER STACKING SYSTEM FOR PRINTERS

[75] Inventors: Steve O. Rasmussen; Thomas A. Pearo, both of Vancouver, Wash.

[73] Assignee: Hewlett-Packard Company, Palo Alto, Calif.

[21] Appl. No.: 954,781

[22] Filed: Sep. 29, 1992

[51] Int. Cl.[5] ..... B65H 31/00

[52] U.S. Cl. ..... 271/189; 271/209; 271/213; 400/647.1

[58] Field of Search ..... 271/189, 192, 188, 209, 271/213; 400/647.1

[56] References Cited

U.S. PATENT DOCUMENTS

| | | | |
|---|---|---|---|
| 3,240,490 | 3/1966 | Fairbanks | 271/188 X |
| 3,288,312 | 11/1966 | Hughes | 271/189 X |
| 4,204,672 | 5/1980 | Grivet | 271/188 |
| 4,728,963 | 3/1988 | Rasmussen et al. . | |
| 4,794,859 | 1/1989 | Huseby et al. . | |
| 4,844,633 | 7/1989 | Greenberg | 271/189 X |

FOREIGN PATENT DOCUMENTS 341901 6/1972 U.S.S.R. .

OTHER PUBLICATIONS

*Hewlett Packard Journal,* DeskJet Printer Chassis and Mechanism Design by Larry A. Jackson, Kieran B. Kelly, David W. Pinkernell, Steve O. Rasmussen, and John A. Widder, pp. 67-75, Oct. 1988.

*Primary Examiner*—Richard A. Schacher

[57] ABSTRACT

A sheet stacking system is provided which includes mechanism designed to compensate for the aerodynamic forces which act on a sheet as it passes from the printer's output port to the floor of the printer's output tray. The system includes a pair of spaced, anti-sail wings which are positioned adjacent the printer's output port so as to controlledly receive just-expelled sheets. The wings are operatively associated with the output tray's floor, and are arranged so that opposite movement thereof results in rear-to-front sequential release of a supported sheet, directing substantially vertical passage of such sheet to the top of an output stack.

14 Claims, 2 Drawing Sheets

PAPER STACKING SYSTEM FOR PRINTERS

TECHNICAL FIELD

The present invention relates generally to a system for use in the collection of sheets expelled from a printer. More particularly, the invention relates to a sheet stacking system which includes mechanism for placing expelled sheets in an aligned output stack.

BACKGROUND ART

In a conventional single-sheet printer, paper is directed through a print cycle which includes picking up a sheet of paper, feeding it into the printer, and then expelling it through the printer's output port. Once expelled, the sheet falls to an output tray, consecutive sheets thus piling one on top of the other to form an output stack. Ideally, the sheets will fall directly to the tray, forming a stack made up of substantially vertically aligned sheets. Such a stack is desirable in both personal and business applications, offering a stack which is substantially stable and easily manipulable for later sheet processing.

Sheets expelled by conventional printers, however, rarely fall directly to the output tray. Instead, sheet fall is made random by a variety of aerodynamic forces, such forces producing an effect known generally in the industry as "sail". Sheet sail most often is characterized by the sheet cutting through the air so as to glide in the direction of sheet expulsion, potentially passing beyond the confines of the output tray. Such an effect results in an increasingly destabilized stack, often culminating in sheets spilling onto the floor and requiring hand restacking of the sheets.

DISCLOSURE OF THE INVENTION

The invented sheet stacking system addresses the sheet sail problems set forth above, such system including mechanism designed to compensate for the aerodynamic forces which act on the sheet as it passes from the printer's output port to the floor of the printer's output tray. Toward this end, the system includes a pair of spaced, anti-sail wings positioned adjacent the printer's output port so as to controlledly receive just-expelled sheets. The wings are operatively movably associated with the tray floor, each defining a sheet-supporting surface. The sheet-supporting surfaces tend toward convergence in the direction of sheet expulsion, and, in the opposite direction, tend toward the tray floor. Simultaneous opposite movement of the wings thus results in rear-to-front sequential release of a supported sheet, directing substantially vertical passage of such sheet to the top of an output stack.

DETAILED DESCRIPTION AND BEST MODE FOR CARRYING OUT THE INVENTION

Figure 1:
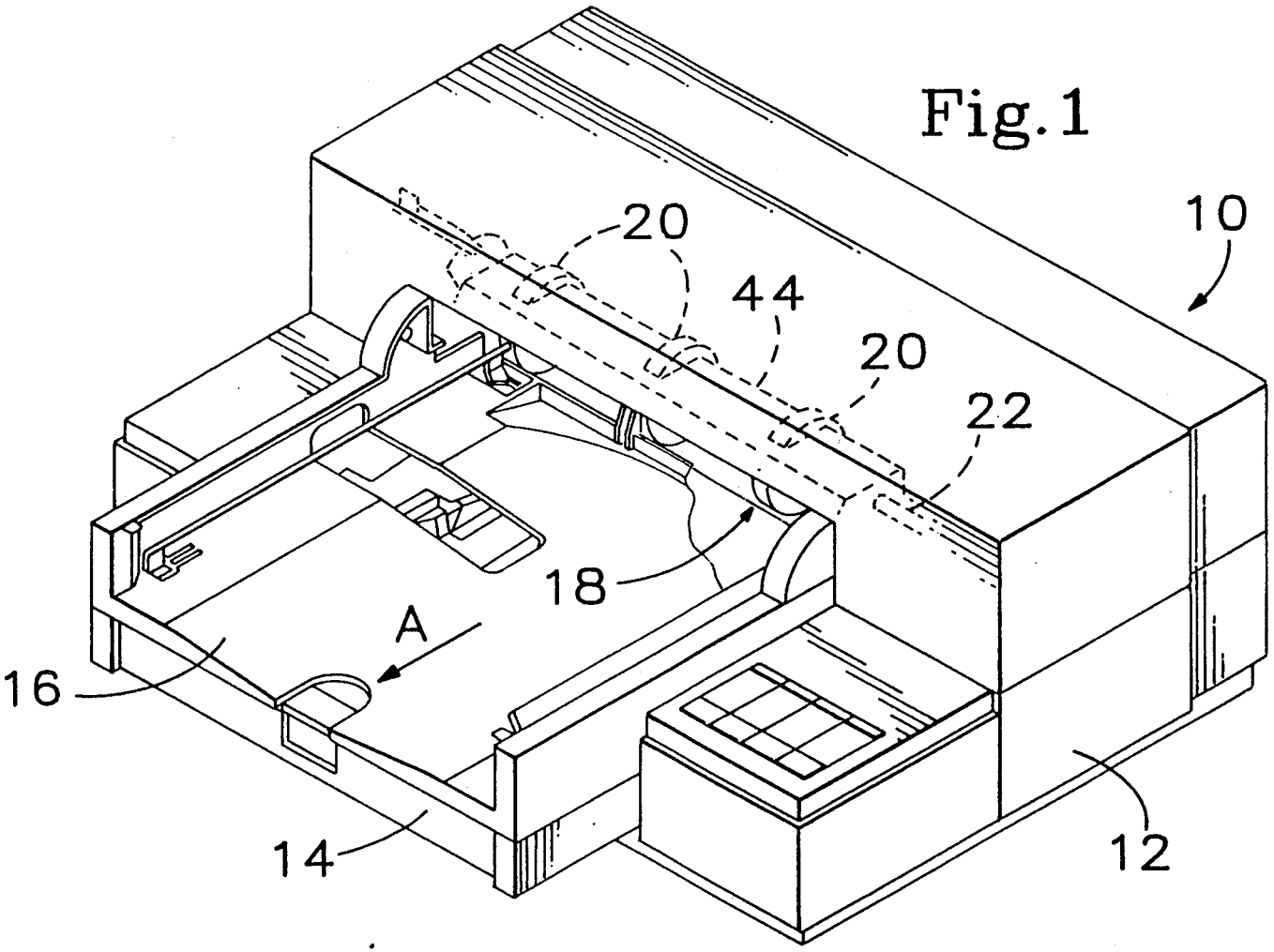
FIG. 1 is an isometric view of a single-sheet printer, such printer incorporating the sheet stacking system of the present invention.

FIG. 1 shows at 10 a typical single-sheet printer, such printer including a chassis 12, an input tray 14, and an output tray 16 (shown partially cut away). During a print cycle, paper is pulled into the printer, printed on, and expelled through the printer's output port 18 in a direction A. Such operation is effected principally using a plurality of spaced drive rollers 20 (shown in dashed lines), the rollers being operatively connected to a motor-driven drive shaft 22 (also shown in dashed lines).

Upon expulsion from the printer, sheets are directed, via the invented sheet stacking system, from the printer's output port to a stack formed on the printer's output tray. When the invented system is used, this operation involves generally linear expulsion of the sheet, momentary support of the sheet above the stack, and gradual, substantially vertical passage of the sheet to the stack. The sheet is thus allowed to reach an at-rest position before being directed to the stack. Where the printer includes an ink-jet printhead, the time is allowed for the ink on a previously expelled and stacked sheet to dry before passing the next sheet thereacross.

In the preferred embodiment, the just-described operation is effected by a sheet stacking system which is housed within the printer's output tray 16. Those skilled in the art, however, will appreciate that the invented system need not be so confined. The system need only be arranged so as to be capable of releasing sheets for vertical passage to the tray.

Figure 2:
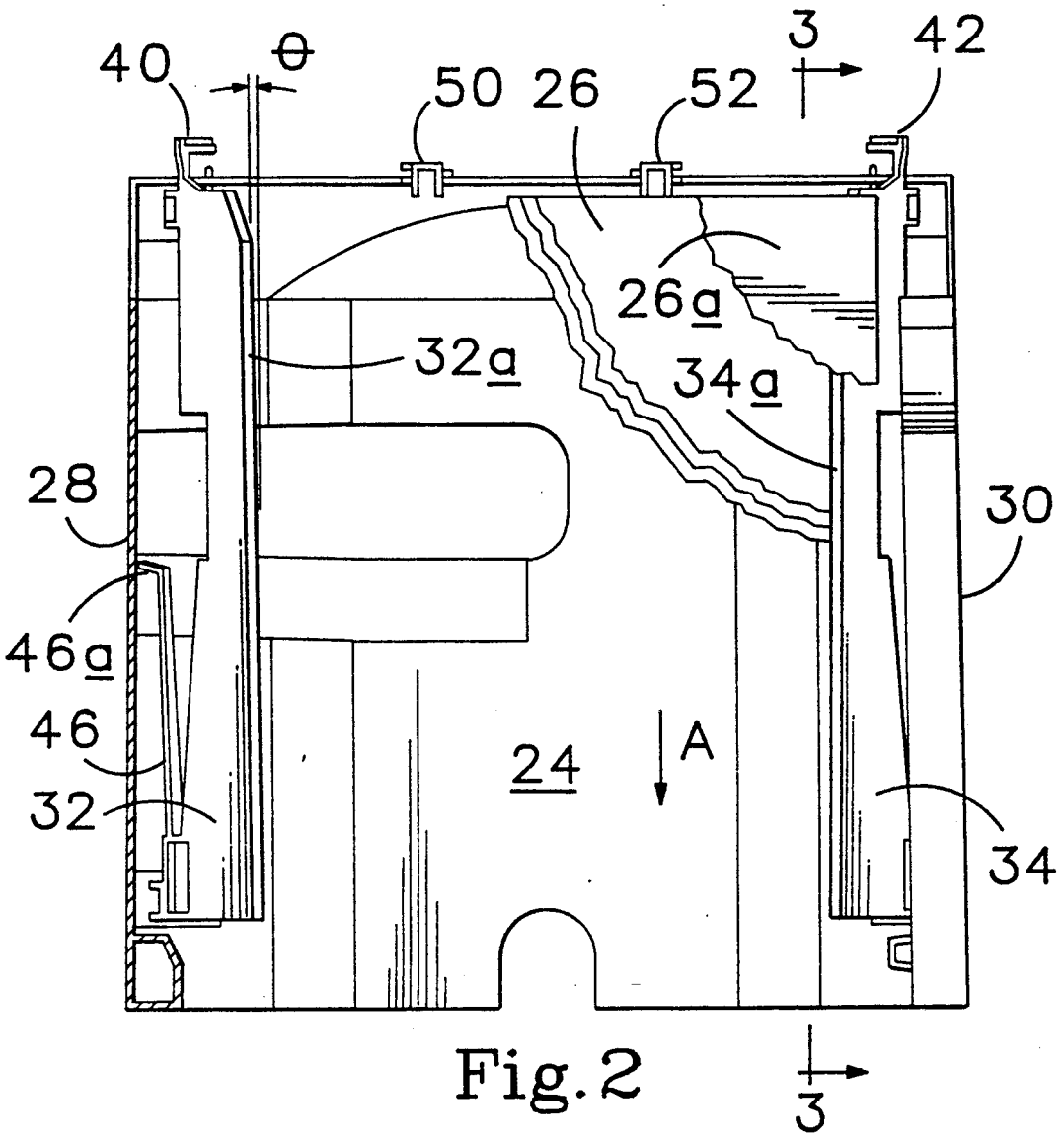
FIG. 2 is a plan view of the output tray from the printer depicted in FIG. 1, the drawing being partially cut away to expose one of the tray's wings.
Figure 3:
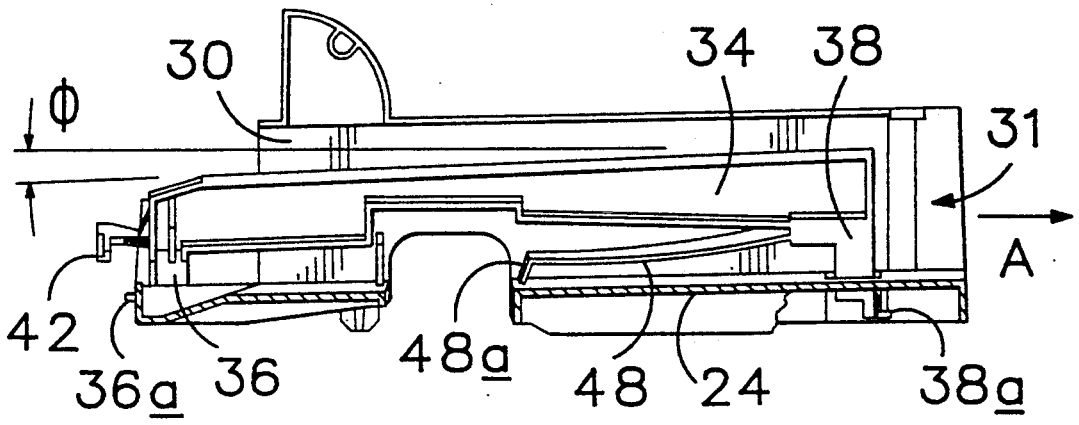
FIG. 3 is a sectional side elevation taken generally along the lines 3—3 in FIG. 2.

In FIGS. 2 and 3, the output tray of printer 10 is shown individually, such tray housing a sheet stacking system which provides for aligned vertical stacking of printer-expelled sheets in the manner described above. As shown, output tray 16 includes a generally horizontal floor 24, the floor being sized and shaped to accommodate support of a sheet stack 26 from below. A pair of spaced side walls 28, 30 are positioned adjacent opposite sides of the floor and extend generally vertically therefrom. The walls, it will be appreciated, are spaced a distance to accommodate placement of expelled sheets therebetween. As is conventional, the output tray is positioned adjacent the printer chassis. A tray cover (not shown) may be placed to extend generally across the tops of the walls, the tray thus defining a channel 31 which is open at only one end.

Operatively pivotally secured to the floor of the tray are a pair of elongate wings 32, 34, each such wing extending along an opposite one of the tray's side walls. As shown, the wings are generally planar, and are normally pivoted to an inwardly acute angle relative to the tray's floor. Each wing defines, in the uppermost region thereof, a sheet-supporting surface **32*a*, 34*a*, such surfaces being capable of selectively, collectively supporting an expelled sheet such as sheet 26*a*. To provide the wings with the structural integrity necessary to support sheet 26*a***, they are stiff, being formed from a lightweight material such as plastic.

In the preferred embodiment, and as best shown in FIG. 3, wing 34 is secured to the tray floor via first and second legs 36, 38, each such leg including a pin **36*a*, 38*a* which is directly pivotally secured to the floor. Pivot of wing 34 is limited in one direction by the tray's side wall 30, and in the other direction by a stop adjacent one of the legs (not shown). Wing 32 is secured to the tray floor in a similar manner. The wings are thus capable of simultaneous pivot relative to tray floor 24, each wing being pivotable in a direction opposite the other so as to effect pivot of the wings between two wing orientations. Such pivot is effected by simultaneous engagement of wing control tabs 40, 42, preferably by the printer's pivot assembly 44 (see FIG. 1**).

Focusing further on structure attendant wings 32, 34, and referring specifically to FIGS. 2 and 3, attention is directed to the fact that such wings are each fitted with a corresponding bias element. In the preferred embodiment, such bias elements are in the form of leaf springs 46, 48 each integrally molded with a corresponding wing. It is to be understood, however, that virtually any biasing element may be used, including coil springs, torsion springs, or the like. Leaf springs 46 and 48 collectively bias the wings toward a paper-supporting first orientation as will be described below. Each leaf spring includes a projection 46*a*, 48*a*, which is angled adjacent its outermost end so as to urge the wing into an inwardly acute angular relationship relative the floor. Toward this end, the springs are yieldably biased against the tray floor.

As best shown in FIG. 2, the wings are configured so that their sheet-supporting surfaces tend toward convergence in a forward direction of sheet expulsion. The innermost edge of each sheet-supporting surface is at an angle relative the direction of sheet expulsion of $\theta$ such angle resulting in an angle of convergence of $2\theta$. Such tendency toward convergence, it will be appreciated, may be achieved by relative angulation of the wings at any convergence angle greater than 0 degrees, but preferably is within the range of between 0.5 and 10 degrees. In the depicted embodiment, the convergence angle is approximately 3 degrees. As best shown in FIG. 3, sheet-supporting surfaces also angle downward toward the tray floor in a direction opposite to the direction of sheet expulsion. The wings may descend rearwardly at any angle which is greater than 0 degrees, but preferably descend at an angle $\theta$ of between 0.5 and 5 degrees. In the depicted embodiment, angle $\theta$ is approximately 1 degree. Although in the preferred embodiment the wings are characterized by both a tendency toward convergence in the direction of sheet travel and a downward angle in the opposite direction, it should be appreciated that either one of these characteristics, individually, will have the desired effect of opposing paper sail.

In the first orientation (shown in FIGS. 2 and 3), the wings are arranged to support just-expelled sheet 26*a*, and in the second orientation, the wings are arranged to allow the sheet to fall to the tray floor as will now be described. By virtue of the slope and convergence of the sheet-supporting surfaces, release of sheet 26*a* occurs in a rear-to-front sequence, allowing passage of air through cavity 31 without causing unwanted paper sail. The forward air current is gradual, and is of a magnitude which does not encourage sail in either direction. Should the paper, however, pass rearwardly, back toward the output port, a pair of upstanding fingers 50, 52 will prevent passage beyond the confines of the tray.

INDUSTRIAL APPLICABILITY

Although particularly well suited for use in single-sheet, ink-jet printers, the above-described sheet stacking system is useful in virtually any printer wherein sheets are expelled individually for vertical stacking thereof. The system is effective in directing an air current forwardly from below the sheet while encouraging substantially direct vertical, or slight rearward, drop of the sheet. Such air current is achieved by configuring the wings so as to release the sheet in a gradual, rear-to-front sequence.

We claim:

1. A sheet stacking system for use in a printer including an output tray for controlled receipt of sheets expelled forwardly from the printer's output port, said system comprising:

a generally horizontal tray floor; and a pair of spaced, elongate wings, each operatively associated with said floor for pivot about an axis corresponding to said wing's length to selectively support one side of an expelled sheet, said wings being arranged to release the sheet rear-to-front upon simultaneous opposite pivot of said wings.

2. The system of claim 1, wherein said wings tend toward convergence in a forward direction.

3. The system of claim 1, wherein said wings tend rearwardly, downwardly toward said tray floor.

4. The system of claim 1, wherein said wings are selectively pivotable between a first orientation wherein said wings collectively support a sheet above said floor and a second orientation wherein said wings allow the sheet to fall onto said floor.

5. The system of claim 4, wherein said wings each include a bias element, said bias elements yieldably urging said wings into said first orientation.

6. A sheet stacking system for use in a printer including an output tray for controlled receipt of sheets expelled forwardly from the printer's output port in a downstream direction, said system comprising:

a generally horizontal tray floor; and a pair of spaced wings operatively associated with said floor, said wings being oppositely movable and tending downwardly toward said floor in an upstream direction to selectively support an expelled sheet with said wings, said floor, and the expelled sheet collectively forming a cavity which defines a forward-biased air passage to oppose sail of a sheet upon wing movement to release such sheet.

7. The system of claim 6, wherein said wings tend toward convergence in a forward direction.

8. The system of claim 6, wherein said wings are pivotally secured to said floor.

9. The system of claim 6, wherein said opposite movement is opposite pivotal movement.

10. The system of claim 6, wherein said wings are selectively movable between a first orientation wherein said wings collectively support a sheet above said floor and a second orientation wherein said wings allow the sheet to fall onto said floor.

11. The system of claim 10, wherein said wings each include a bias element, said bias elements yieldably urging said wings into said first orientation.

12. A sheet stacking system for use in a printer including an output tray for controlled receipt of sheets expelled from the printer's output port, said system comprising:

a generally horizontal tray floor; and a pair of spaced wings, each operatively associated with said floor for pivot about a generally horizontal axis and including a sheet-supporting surface, said sheet-supporting surfaces tending toward convergence in a direction of sheet expulsion and tending downwardly toward said tray floor in a direction opposite said direction of sheet expulsion.

13. The system of claim 12, wherein said wings are selectively movable between a first orientation wherein said wings collectively support a sheet above said floor and a second orientation wherein said wings allow the sheet to fall onto said floor.

14. The system of claim 13, wherein said wings each include a bias element, said bias element yieldably urging said wings into said first orientation.

* * * * *